US007425158B2

(12) United States Patent
Ookura

(10) Patent No.: US 7,425,158 B2
(45) Date of Patent: Sep. 16, 2008

(54) CONNECTOR AND MANUFACTURING METHOD OF THE SAME

(75) Inventor: Kenji Ookura, Hisai (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/561,526

(22) PCT Filed: Mar. 28, 2005

(86) PCT No.: PCT/JP2005/005758

§ 371 (c)(1),
(2), (4) Date: Dec. 20, 2005

(87) PCT Pub. No.: WO2005/096453

PCT Pub. Date: Oct. 13, 2005

(65) Prior Publication Data

US 2007/0105408 A1 May 10, 2007

(30) Foreign Application Priority Data

Mar. 31, 2004 (JP) ..... 2004-107305

(51) Int. Cl.
*H01R 24/00* (2006.01)

(52) U.S. Cl. ..... 439/660; 439/74

(58) Field of Classification Search ..... 439/74, 439/660

See application file for complete search history.

(56) References Cited

U.S. PATENT DOCUMENTS 5,639,248 A 6/1997 Yagi
5,641,290 A 6/1997 Yagi
5,842,875 A 12/1998 Yagi
5,975,916 A * 11/1999 Okura ..... 439/74

(Continued)

FOREIGN PATENT DOCUMENTS

JP 63-47579 3/1988

(Continued)

OTHER PUBLICATIONS

English language abstract of JP 2002-008753.

(Continued)

*Primary Examiner*—Ross N Gushi
(74) *Attorney, Agent, or Firm*—Greenblum & Bernstein, P.L.C.

(57) ABSTRACT

A socket body and a header body are respectively reinforced by inserted reinforcing members, so that a protruding table in a plug groove of the socket body is eliminated and a width dimension thereof is reduced. The socket body is formed in a flat rectangular parallelepiped shape by resin molding, and a pair of socket reinforcing members is inserted into both end portions in longitudinal direction, each having a pair of fixed portions respectively protruding outward from lower ends of side walls of the socket body and a coupling portion for coupling between a pair of the fixed portions. A plug groove of substantially rectangular shape is formed at center portion of the socket body, and plural pairs of socket contacts are respectively arranged in two lines on both side walls in longitudinal direction along the plug groove. Header reinforcing metal fittings formed on the same base metal and having substantially the same cross section as that of the header posts are integrally inserted into both end portions of the header body in the longitudinal direction.

9 Claims, 10 Drawing Sheets

U.S. PATENT DOCUMENTS

| | | | | |
|---|---|---|---|---|
| 6,619,965 | B1 * | 9/2003 | Kihira et al. | 439/74 |
| 6,623,308 | B2 | 9/2003 | Ono | |
| 6,806,801 | B2 | 10/2004 | Kadoya et al. | |
| 6,821,158 | B2 | 11/2004 | Lida et al. | |
| 2004/0014335 | A1 * | 1/2004 | Igarashi et al. | 439/74 |
| 2005/0009383 | A1 | 1/2005 | Okura et al. | |

FOREIGN PATENT DOCUMENTS

| | | |
|---|---|---|
| JP | 7-63670 | 7/1995 |
| JP | 2002-008753 | 1/2002 |
| JP | 2003-017162 | 1/2003 |
| JP | 2004-055306 | 2/2004 |
| JP | 2004-055464 | 2/2004 |
| JP | 2004-111081 | 4/2004 |

OTHER PUBLICATIONS

English language abstract of JP 2003-017162.
English language abstract of JP 2004-055464.
English language abstract of JP 2004-055306.
English language abstract of JP 2004-111081.
U.S. Appl. No. 10/561,527 to Ookura, filed Dec. 20, 2005.
U.S. Appl. No. 10/558,486 to Ookura, filed Dec. 28, 2005.

* cited by examiner

FIG. 12A
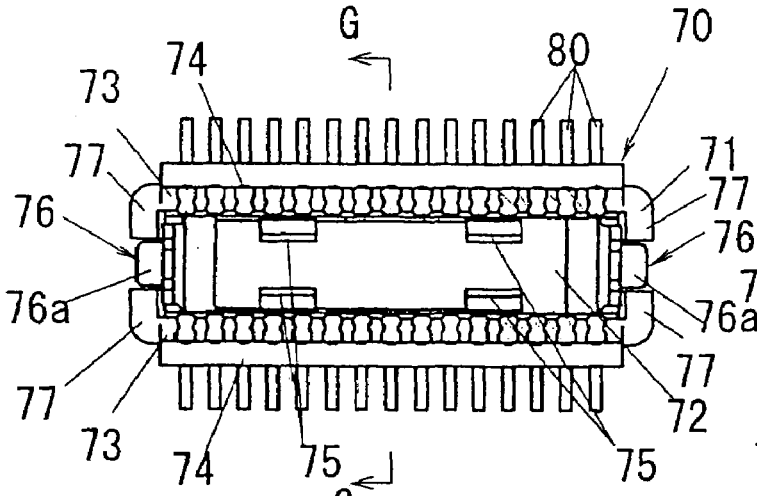
FIG. 12B
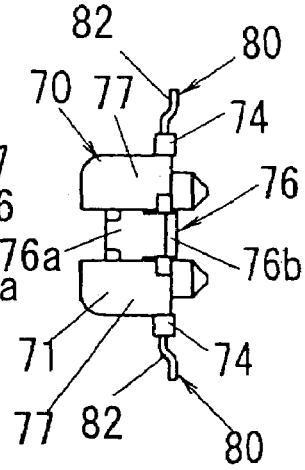
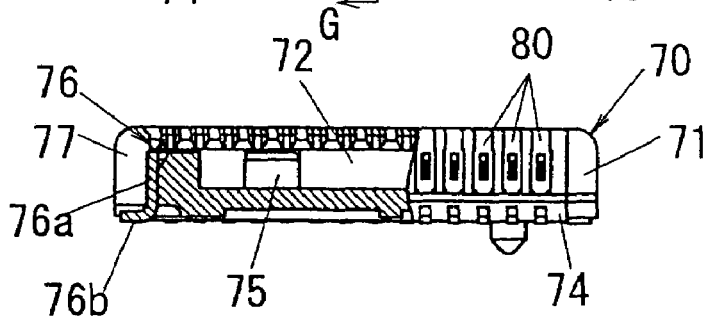
FIG. 12C
FIG. 13
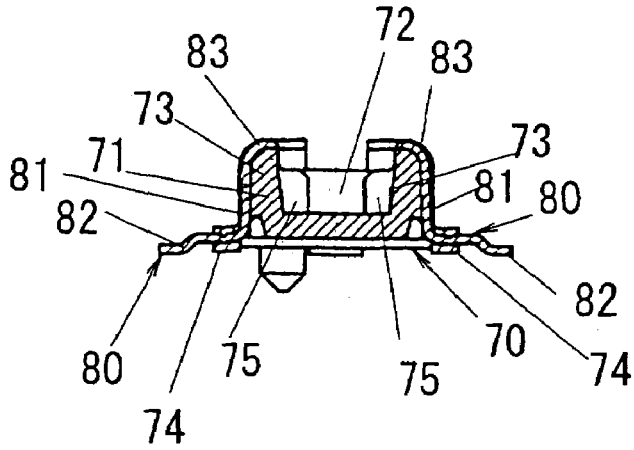

CONNECTOR AND MANUFACTURING METHOD OF THE SAME

TECHNICAL FIELD

The present invention relates to a connector comprising a socket and a header for electrically connecting between circuit boards or a circuit board and an electronic component in compact electronic equipment such as a mobile phone, and a manufacturing method of the same.

BACKGROUND ART

Conventionally, a connector which is comprised of a socket and a header is provided for electrically connecting between circuit boards, for example, an FPC and a hard board. A conventional connector mentioned in, for example, Japanese Laid-Open Patent Publication No. 2002-8753 is described with reference to FIGS. 10A to 10C, FIG. 11, FIGS. 12A to 12C and FIG. 13.

As shown in FIGS. 10A to 10C and FIG. 11, a socket 50 has a socket body 51 which is formed into a substantially flat rectangular parallelepiped shape by resin molding and a plurality of socket contacts 60 which is arranged on two lines along longitudinal direction of the socket body 51. Seen from front, a protruding table 53 of substantially rectangular parallelepiped shape is formed in a center portion of the socket body 51, and a plug groove 52 of substantially rectangular shape is formed between the protruding table 53 and each side wall 54 in longitudinal direction and each side wall 56 in widthwise direction. Mechanical strength of the socket body 51 is reduced due to forming the plug groove 52. Therefore, socket reinforcing metal fittings 56 are press-fitted into side walls 57 of the socket body 51 in widthwise direction.

The socked contact 60 is formed by bending a band metal into a predetermined shape by press working. A first contact portion 61 which is to be contacted with a header post 80 (referring to FIGS. 12A to 12C and FIG. 13) is formed at a first end portion of each socket contact 60 facing the plug groove 52. A first terminal portion 62 which is to be soldered on a conductive pattern of a circuit board is formed at a second end portion of the socket contact 60 positioned outward of the side wall 54. Each socket contact 60 is press-fitted after resin molding of the socket body 51. An end 56*a* of the socket reinforcing metal fitting 56 is press-fitted into the side wall 57 of the socket body 51 as mentioned above, and the other end 56*b* is soldered on a circuit board with the first terminal portion 62 of the socket contact 60.

On the other hand, as shown in FIGS. 12A to 12C and FIG. 13, a header 70 has a header body 71 which is formed in a shape of substantially flat rectangular parallelepiped by resin molding and a plurality of header post 80 which is arranged on two lines along longitudinal direction of the header body 71. An engaging groove 72 of substantially rectangular parallelepiped shape with which the protruding table 53 is engaged is formed at a position facing the protruding table 53 of the socket body 51. Flange portions 74 are formed on side walls 73 of the header body 71 so as to protrude substantially perpendicular to the side walls 73 from edges on rear face side (circuit board side) of the header body 71. Furthermore, engaging protrusions 75 which are to be engaged with key grooves 55 provided on the protruding table 53 of the socket 50 are formed at four positions on wall faces of the side walls 73 in side of the engaging groove 72 so that impact applied while the socket 50 and the header 70 are connected is dispersed. Header reinforcing metal fittings 76 are inserted into both end portions 77 of the header body 71 in longitudinal direction.

The header post 80 is formed by bending a band metal into a predetermined shape by press working. A second contact portion 81 which is to be contacted with the first contact portion 61 of the socket contact 60 is formed at a position of each header post 80 along an outer surface of the side wall 73. Furthermore, a second terminal portion 82 which is to be soldered on a conductive pattern of a circuit board is formed at an end portion protruding outward from the flange portion 74. Each header post 80 is integrally fixed on the header body 71 by insert molding while the header body 71 is molded by resin. An end 76*a* of the header reinforcing metal fitting 76 is inserted into the end portion 77 of the header body 71 as mentioned above, and the other end 76*b* is soldered on a circuit board with the second terminal portion 82 of the header post 80.

The socket 50 and the header 70 are mounted so that the first terminal portion 62 of each socket contact 60 and the second terminal portion 82 of each header post 80 are respectively soldered on conductive patterns of circuit boards. When the header 70 is engaged with the plug groove 52 of the socket 50, the protruding table 53 of the socket 50 is relatively engaged with the engaging groove 72 of the header 70, and the first contact portion 61 of the socket contact 60 contacts the second contact portion 81 of the header post 80 with elastic deformation. As a result, a circuit board on which the socket is mounted is elastically connected with a circuit board on which the header 70 is mounted.

Generally, when the plug groove 52, with which the header body 71 is engaged, is formed on the socket body 51, mechanical strength of the socket body 51 becomes weak so that it is easily deformed. In the above-mentioned conventional connector, in order to increase the mechanical strength of the socket body 51, the protruding table 53 is provided in the inside of the plug groove 52, and the engaging groove 72 which is to be engaged with the protruding table 53 is formed on the header body 71. Therefore, the conventional connector has a problem that dimensions in widthwise directions of the socket body 51 and the header body 71 becomes larger by the dimension of the protruding table 53.

Furthermore, since the socket reinforcing metal fittings 56 are press-fitted into the side walls 57 of the socket body 51, the side walls 57 become thick. Similarly, since the header reinforcing metal fittings 76 are inserted into both end portions 77 of the header body 71 in the longitudinal direction, a dimension of the header body 71 in the longitudinal direction becomes larger. Still furthermore, the plug groove 52 of the socket body 51 becomes longer in the longitudinal direction following that the dimension of the header body 71 in the longitudinal direction becomes larger. Consequently, there is a problem that the dimensions of not only the socket body 51 but also the connector itself become larger.

DISCLOSURE OF INVENTION

A purpose of the present invention is to provide a connector by which a dimension in longitudinal direction and a dimension in widthwise direction can be reduced with maintaining mechanical strengths of a socket body and a header body, and a manufacturing method of the same.

A connector in accordance with an aspect of the present invention includes:

a header comprising a header body formed of an insulation material, and plural pairs of header posts held on both side walls of the header body; and a socket comprising a socket body formed on an insulation material and having a plug groove with which the header is engaged, and plural pairs of socket contacts held on both side walls of the plug groove of the socket body and contacted with the header posts when the header is engaged with the plug groove; characterized by that the socket body is reinforced by a pair of socket reinforcing metal fittings integrally inserted into both end portions thereof in longitudinal direction;

a pair of the socket reinforcing metal fittings is formed to protrude outward from both side walls of the plug groove in longitudinal direction, and have a pair of fixed portions to be soldered on lands of a circuit board and a coupling portion connecting between the fixed portions and embedded into an end portion of the socket body in the longitudinal direction, respectively.

According to such a configuration, the dimension of the connector in widthwise direction can be made smaller than that of the conventional one by eliminating the protruding table of the socket body. Furthermore, for at least the socket body is reinforced by the inserted socket reinforcing metal fittings. Thus, mechanical strength of the socket body is maintained although the protruding table of the socket body is eliminated.

Still furthermore, it is possible that the header body is reinforced by a pair of header reinforcing metal fittings respectively integrally inserted into both end portions thereof in longitudinal direction, and the header reinforcing metal fittings each has a sectional shape in widthwise direction substantially the same as that of the header post.

According to such a configuration, mechanical strength of the header body is maintained. Furthermore, conductive terminals formed for header post can be diverted to the header reinforcing metal fitting as a loss pin, so that any special insert molding process is not necessary for the header reinforcing metal fittings. Consequently, the method for manufacturing the conventional connector can be diverted without change.

Furthermore, a manufacturing method of a connector in accordance with an aspect of the present invention is the method for manufacturing the connector including:

a header comprising a header body formed of an insulation material, and plural pairs of header posts held on both side walls of the header body; and a socket comprising a socket body formed on an insulation material and having a plug groove with which the header is engaged, and plural pairs of socket contacts held on both side walls of the plug groove of the socket body and contacted with the header posts when the header is engaged with the plug groove; characterized by comprising:

the plural pairs of header posts are (SIC);

a process for forming conductive terminals having substantially the same shape as the header post serially at a predetermined pitch along two lines opposing with each other on band shaped metal plates by punching work;

a process for inserting a number of pairs of the conductive terminals larger by two than a number of pairs of the plural pairs of the header posts among the two lined conductive terminals formed on the metal plate into a die;

a process for insert molding of insulation resin so that two pairs of the conductive terminals positioned at both sides among the conductive terminals inserted into the die are embedded into the inside in vicinities of both side portions of the header body in longitudinal direction; and a process for cutting the conductive terminals unified with the header body by insert molding from the metal plate.

According to such manufacturing method, it is possible to manufacture a compact header in which mechanical strength thereof is reinforced by the header reinforcing metal fittings by using the conventional insert molding method for the connector, especially, the header without change.

BRIEF DESCRIPTION OF DRAWINGS

FIG. 12A is a front view showing the header of the conventional connector, FIG. 12B is a right side view thereof and FIG. 12C is a bottom view thereof.

FIG. 13 is a side sectional view of the header of the above conventional connector.

BEST MODE FOR CARRYING OUT THE INVENTION

Figure 1:
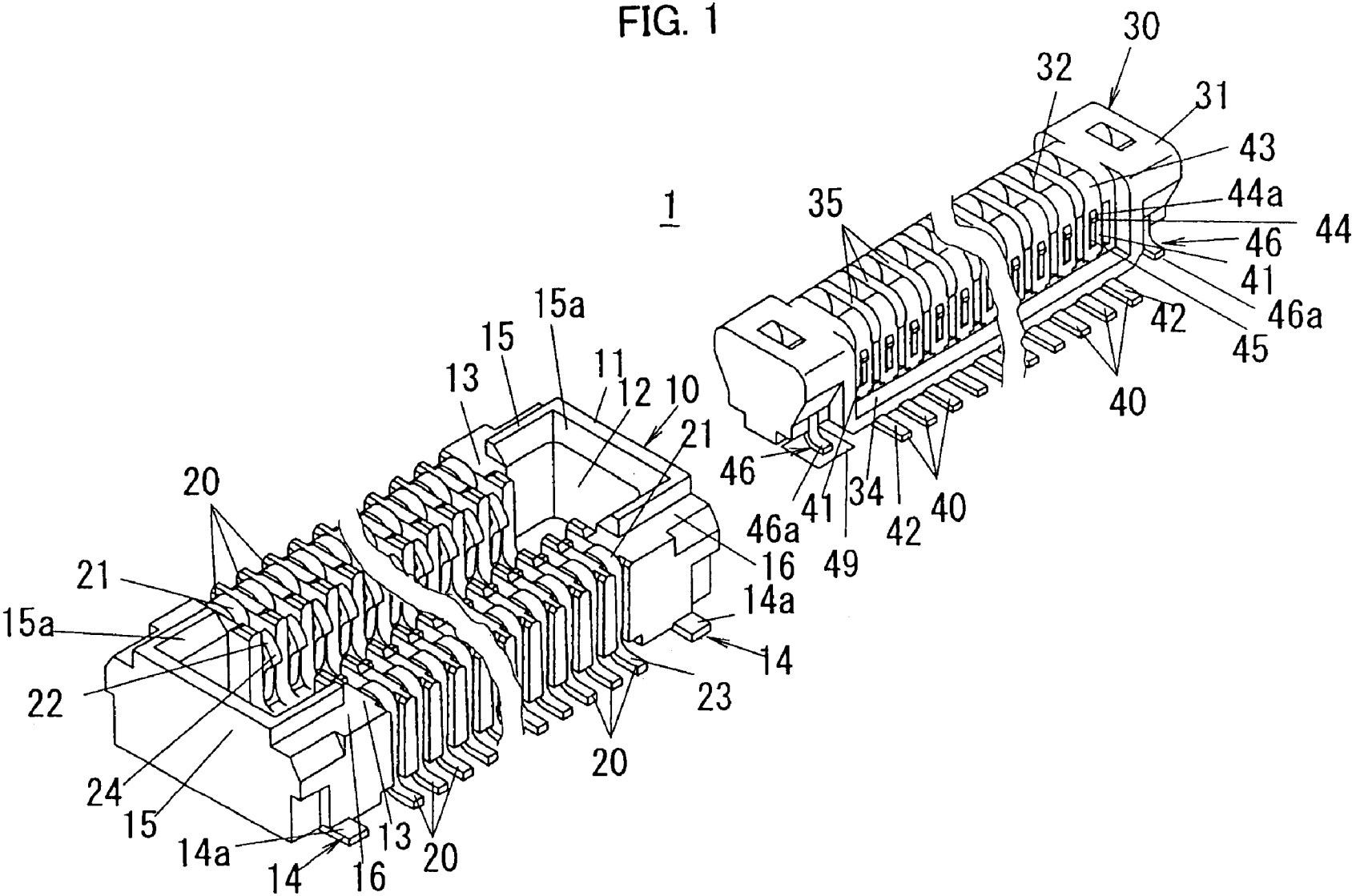
FIG. 1 is a perspective view showing a connector in accordance with an embodiment of the present invention in a state that a socket and a header thereof are divided.

A connector and a manufacturing method of the same in accordance with an embodiment of the present invention are described in detail with reference to the drawing. A connector 1 of this embodiment is used, for example, electrically to connect between circuit boards or electronic components and the circuit board in compact electronic equipment such as a mobile phone, and it comprises a socket 10 and a header 30 as shown in FIG. 1. Especially, in a flip phone, the circuit board is divided into a plurality of pieces, and a flexible printed-circuit board (FPC) is used for hinge portion. As an example, such connector 1 is used for electrically connecting an FPC with flexibility and a hard circuit board. For example, the socket 10 is mounted on a conductive pattern formed on the hard circuit board by soldering, and the header 30 is mounted on a conductive pattern on the FPC by soldering. Then, by connecting the header 30 with the socket 10 as shown in FIG. 2, the hard circuit board and the FPC can be electrically connected.

As shown in FIG. 1 and FIGS. 3A to 3C, the socket 10 has a socket body 11 formed in a flat rectangular parallelepiped shape by resin molding, and a plurality of socket contacts arranged in two lines along side walls 13 of the socket body 11 in longitudinal direction. Seen from front, a substantially rectangular plug groove 12 is formed in center portion of the socket body 11. Guide walls 15 of substantially square cornered U-shape are provided for protruding toward the header 30 side on a plane of the socket body 11 facing the header 20 and in the vicinity of both end portions of the plug groove 12 in longitudinal direction. Slanted faces 15*a* are formed on inner peripheries (that is, the plug groove 12 side) of the guide walls 15.

Figure 2:
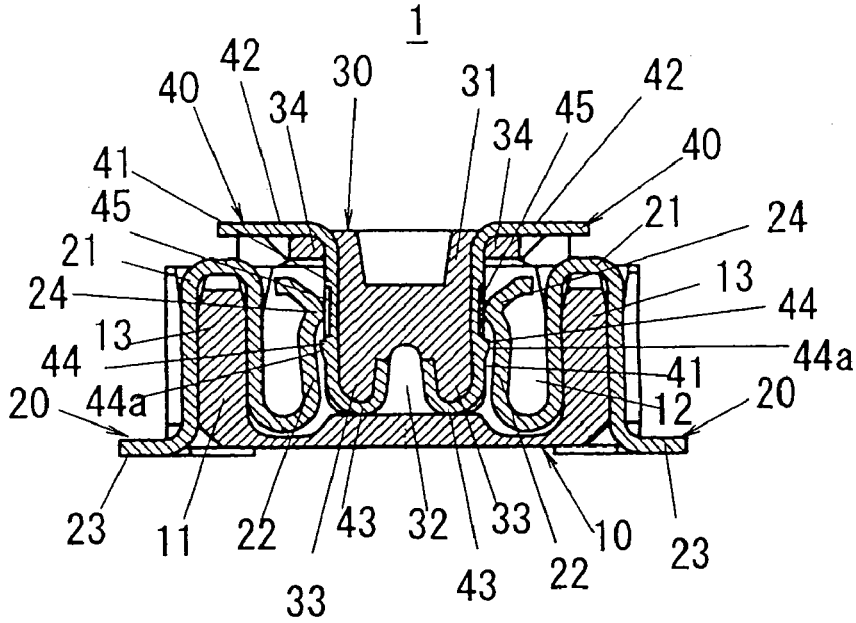
FIG. 2 is a sectional side view showing the connector in accordance with the above embodiment in a state that the socket and the header are connected.
Figure 4:
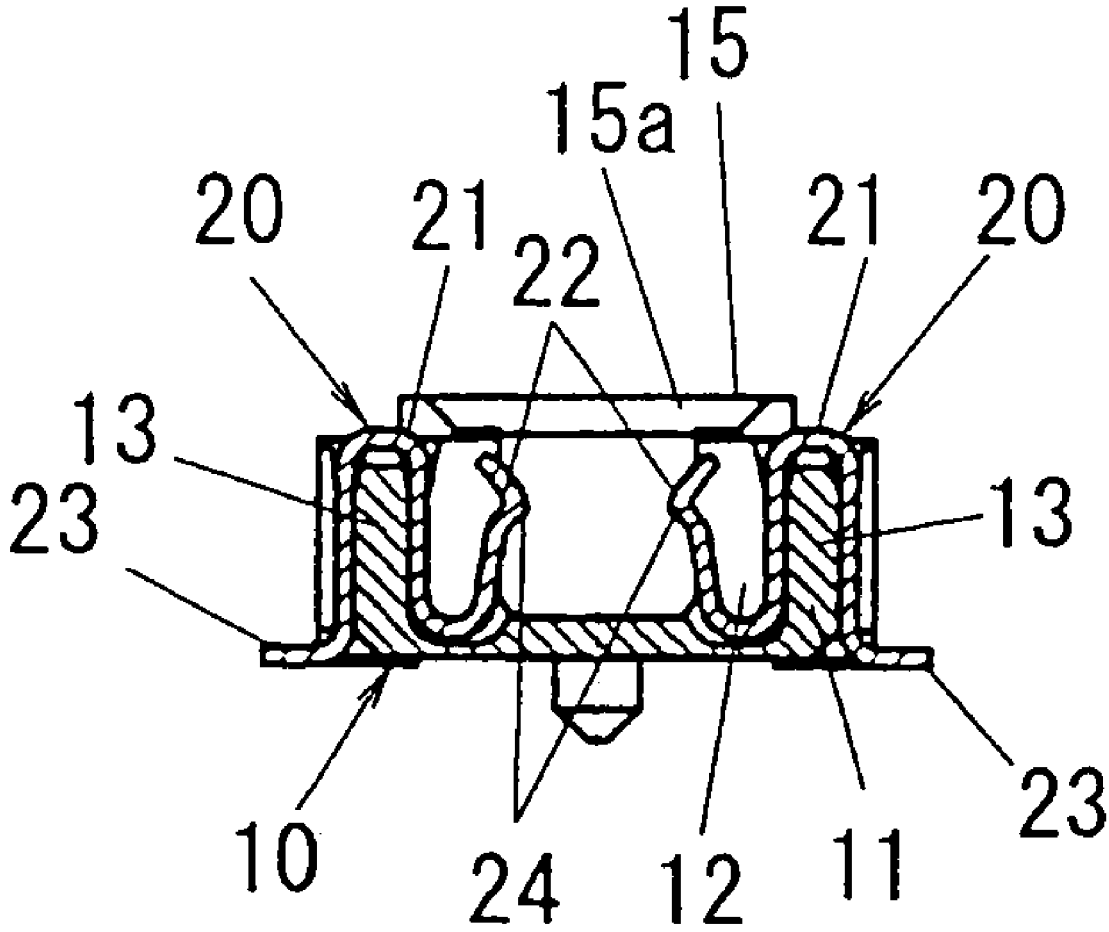
FIG. 4 is aside sectional view of the above socket.

As shown in FIG. 2 and FIG. 4, each socket contact 20 is formed by bending a band metal into a predetermined shape by press working. Each socket contact 20 is press-fitted after resin molding of the socket body 11. As mentioned above, since the pitch between each socket contact 20 is very narrow as 0.4 mm extent, it is nonsense to form the socket contacts 20 and to press-fit those into grooves formed on the side walls of the socket body 11 one by one. Therefore, slit processing is given to a side of a plate base metal so as to form a comb-shaped portion, and press working is further given to the comb-shaped portion to be a predetermined shape. Then, the socket contacts 20 which are arranged in a line on a base of the base metal are simultaneously press-fitted into the grooves formed on the side walls 13 of the socket body 11. Finally, each socket contact 20 is cut off from the base metal.

The socket contact 20 has a held portion 21 formed as substantially reverse U-shape and held on the socket body 11 in a manner to pinch an edge portion of the side wall 13 of the socket body 11, a flexure portion (first contact portion) 22 continuously formed from a portion of the held portion 21 positioned inside of the plug groove 12 and having a substantially U-shape opposite to the substantially reverse U-shape of the held portion 21, and a terminal portion 23 soldered on a conductive pattern of the circuit board and formed to protrude outward in a direction substantially perpendicular to the side walls 13 from a lower end portion (end portion on a side mounted on a circuit board) of outer face of the side wall 13 of the held portion 21. The flexure portion 22 is flexible in the direction substantially perpendicular to the side wall 13 inside of the plug groove 12. Furthermore, a contact salient 24 (free end of the first contact portion) protruding in a direction departing from the held portion 21 is formed on the flexure portion 22 by bending.

Figure 3A:
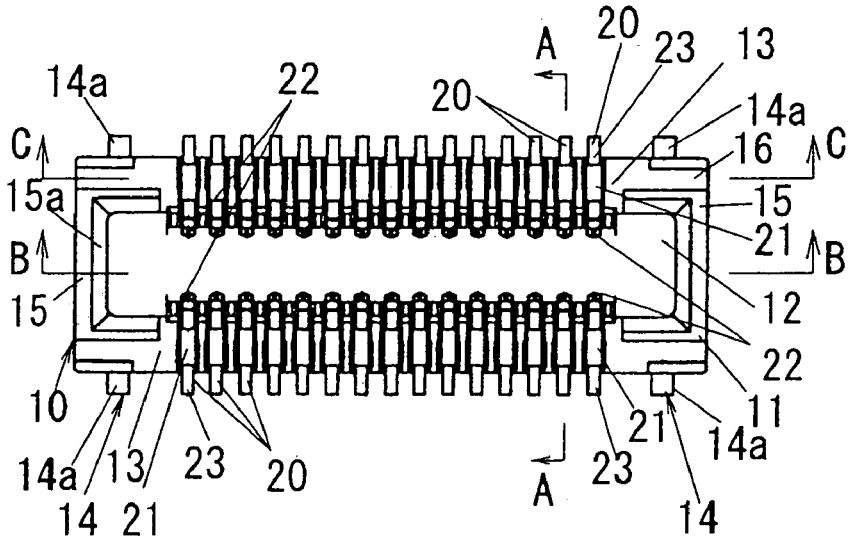
FIG. 3A is a front view showing the socket of the connector in accordance with the above embodiment.
Figure 3B:
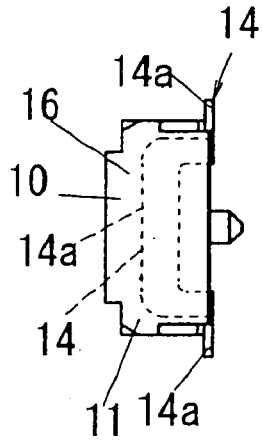
FIG. 3B is a right side view thereof and FIG. 3C is a bottom view thereof.
Figure 3C:
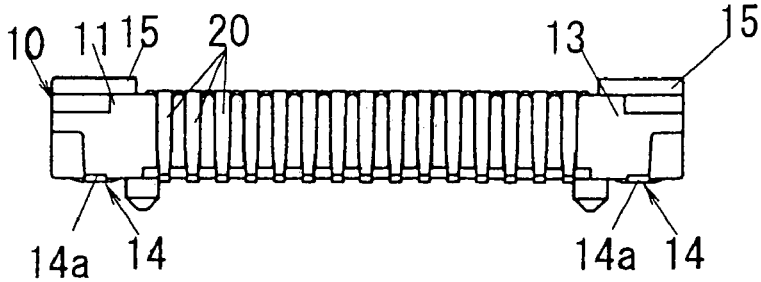
Figure 5A:
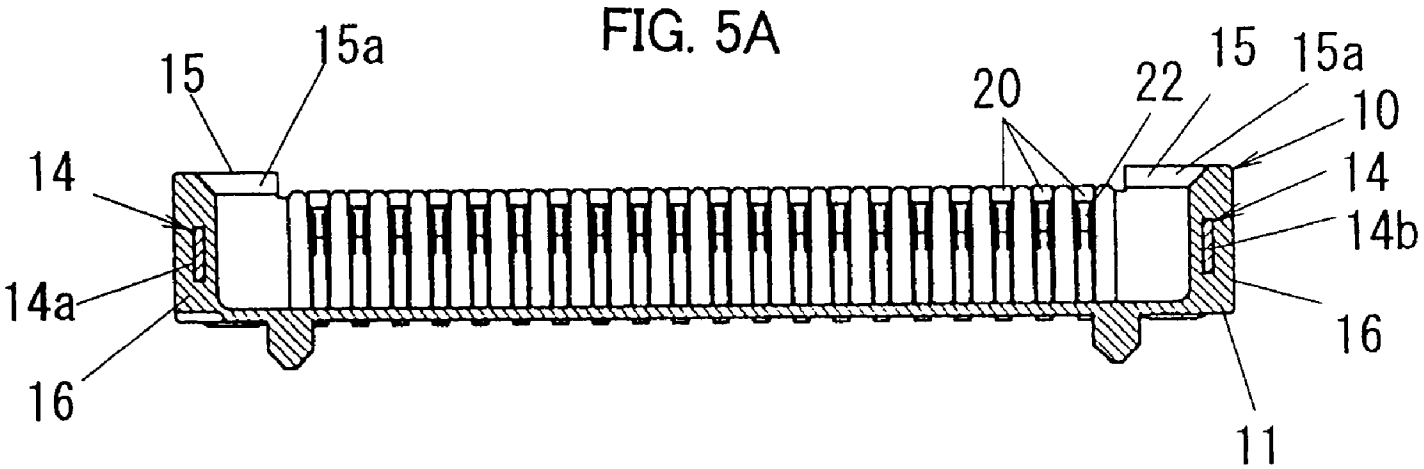
FIG. 5A is a front view showing the header of the connector in accordance with the above embodiment.
Figure 5B:
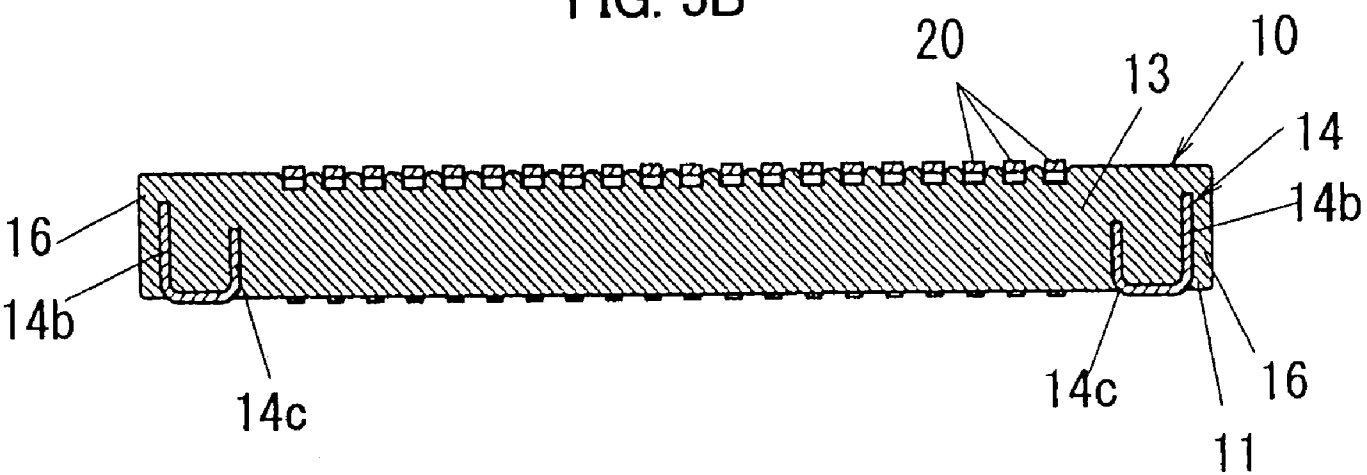
FIG. 5B is a right side view thereof.

In addition, as shown in FIG. 3B and FIGS. 5A and 5B, socket reinforcing metal fittings 14 are embedded in both end portions 16 of the socket body 11 in longitudinal direction (i.e., in the direction of the longitudinal extent of the reinforcing metal fittings 14 which correspond to the width-wise direction of the socket) by insert molding. The socket reinforcing metal fitting 14 has a pair of fixed portions 14*a* respectively protruding outward from the lower ends of the side walls 13 of the socket body 11, a coupling portion 14*b* of substantially reverse U-shape coupling between a pair of the fixed portions 14*a* and embedded in the socket body 11, and an extension portion 14*c* embedded in the side wall 13 of the socket body 11 in the longitudinal direction and forming a substantially U-shaped section with the coupling portion 14*b* (referring to FIG. 5B). The extension portion 14*c* itself is substantially L-shape, and the fixed portion 14*a* of the socket reinforcing metal fitting 14 is arranged to protrude in a direction substantially perpendicular to the side wall 13 from the extension portion 14*c* and to be substantially the same height as the terminal portions 23 of the socket contacts 20. When the terminal portions 23 of the socket contacts 20 are soldered on a conductive pattern of a circuit board, the fixed portions 14*a* of the socket reinforcing metal fitting 14 are soldered on lands of the circuit board simultaneously. Thereby, fixing strength of the socket body 11 to the circuit board can be reinforced. Furthermore, the stress applied to the socket contact 20 when the socket 10 and the header 30 are connected can be reduced by the fixed portions 14*a* of the socket reinforcing metal fittings 14. Since the socket reinforcing metal fittings 14 are inserted into both end portions 16 and both side walls 13 in the longitudinal direction of the socket body 11, the mechanical strength of the socket body 11 can be increased. Furthermore, it is possible to make both end portions 16 and both side walls of the socket body 11 thinner in comparison with the case that the socket reinforcing metal fittings are press-fitted into the socket body 11.

As shown in FIG. 1 and FIGS. 6A to 6C, the header 30 has a header body 31 formed in an elongated substantially rectangular parallelepiped shape by resin molding, and a plurality of header posts 40 arranged in two lines along both side walls 33 of the header body 31 in the longitudinal direction. In the longitudinal direction of the header 30, each cross wall 35 is formed between two adjoining header posts 40 so as to join with both side walls 33. As shown in FIG. 7, in widthwise direction of the header 30, a pair of header posts 40 are disposed for facing each other in a space enclosed by two cross walls 35, and a concave portion 32 is formed between a pair of the header posts 40, in other words, in a center portion of a first face of the socket body 11 in a side to be engaged with the plug groove 12 in the widthwise direction. Furthermore, in the vicinity of the lower ends of each side wall 33 (end portion in a second face side to be mounted on a circuit board), a flange portion 34 is formed along the longitudinal direction to protrude outward in a direction substantially perpendicular to the side wall 33.

Figure 6A:
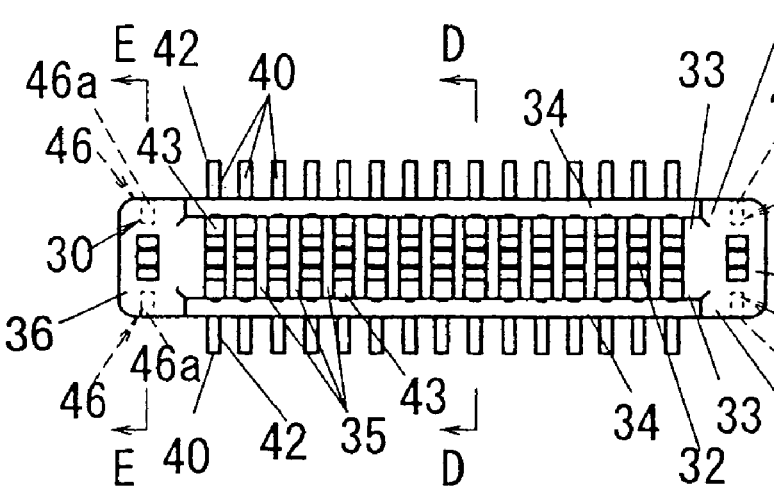
FIG. 6A is a front view showing the header of the connector in accordance with the above embodiment.
Figure 6B:
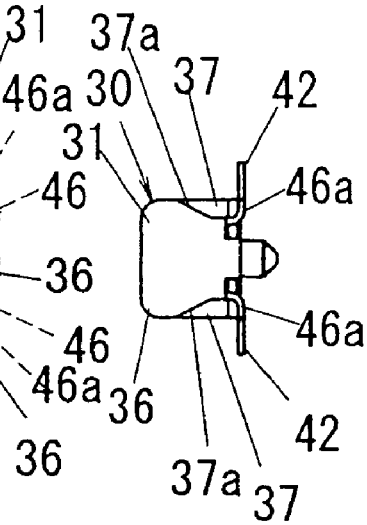
FIG. 6B is a right side view thereof.
Figure 7A:
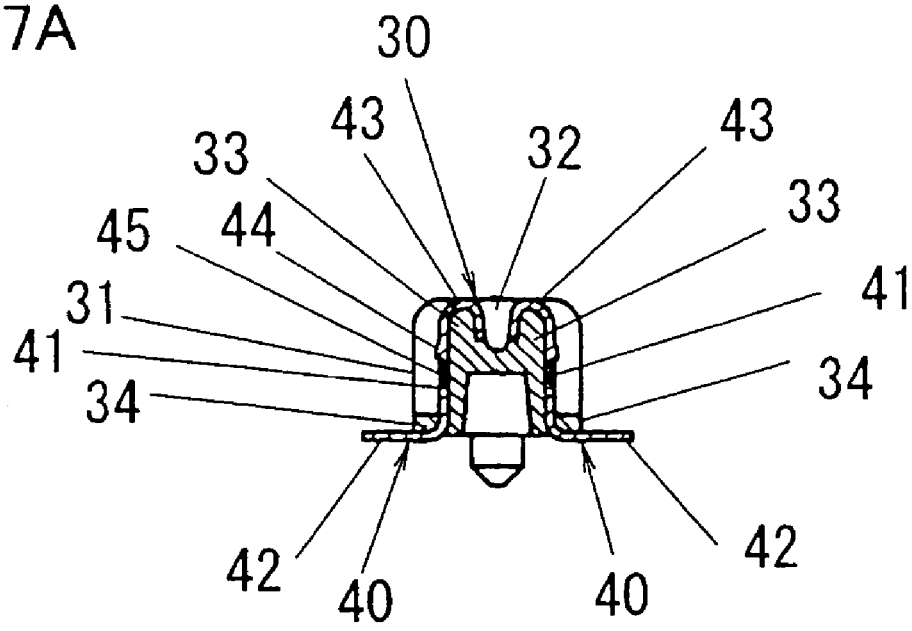
FIG. 7A is A-A sectional view in FIG. 6A.

As shown in FIG. 6B, slanted faces 37*a* are formed on end portions 36 of the header body 31 so as to be slanted inwardly to a bottom face (right side in the figure) from upper side (left side in the figure), so that concave portions 37 are formed, consequently. According to these concave portions 37, soldering portions becomes easily viewable when header reinforcing metal fittings 46 which will be mentioned later are soldered on lands 49 of a circuit board (referring to FIG. 1). Thereby, the soldering work can be performed easily.

As shown in FIG. 2 and FIG. 7, each header post 40 is formed by bending a band metal into a predetermined shape by press working. Each header post 40 is unified with the header body 31 by insert molding when the header body 31 is molded by resin. The header post 40 is formed to follow along outer wall of the side wall 33 of the header body 31, and has a second contact portion 41 to be contacted with the contact salient 24 of the socket contact 20, a terminal portion 42 formed to protrude outward in a direction substantially perpendicular to the side wall 33 from the flange portion 34 and to be soldered on a conductive pattern of a circuit board, and a curved portion 43 formed in a substantially reverse U-shape striding across the side wall 33 from the vicinity of a peak of the side wall 33 and reaching to the vicinity of a bottom of the concave portion 32. A curvature radius of outer surface side of the curved portion 43 is established to be the smallest curvature radius so that the flexure portion (first contact portion) 22 of the contact 20 is rarely buckled due to scratching with the curved portion 43.

Figure 6C:
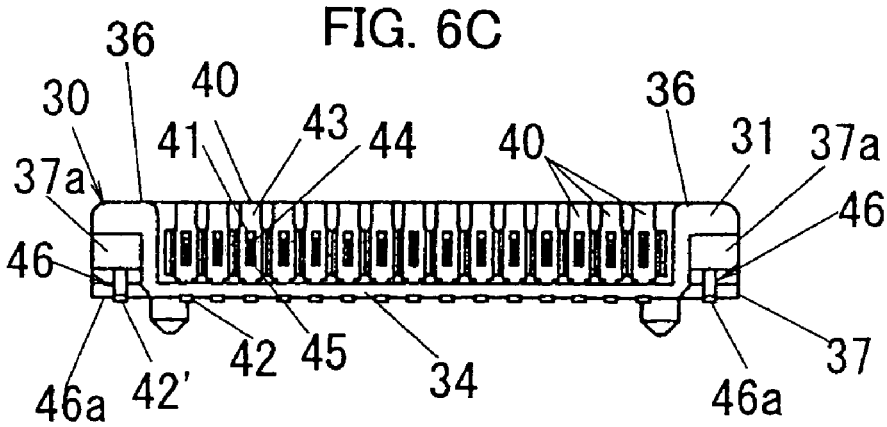
FIG. 6C is a bottom view thereof.

Furthermore, as shown in FIG. 1, FIG. 2, FIG. 6C and FIG. 7A, a protrusion 44 and a concavity 45 are provided at positions of the second contact portion 41 of the header post 40 where the contact salient 24 of the socket contact 20 slides. Specifically, as shown in FIG. 1 and FIG. 6C, the protrusion 44 is formed at a position a little upper (opposite side to the protrusion of the terminal portion 42) than the center of the header post 40 in heightwise direction. A slanted face 44*a* is formed on an outer face of the protrusion 44 so that a dimension of protrusion at a portion nearer to the terminal portion 42 becomes larger. The concavity 45 is a channel shape elongating along the heightwise direction of the header post 40, and has two slanted faces depth of which becomes deeper for approaching to the center in the widthwise direction so that the section in the widthwise direction of the header post 40, that is, the direction crossing at right angle with the above heightwise direction becomes substantially V-shape. A width dimension of the concavity 45 in the widthwise direction of the header post 40 is formed to be wider than a width dimension of the protrusion 44, and smaller than a width dimension of the contact salient 24. In addition, the dimensions and position of the concavity 45 in the heightwise direction of the header post 40 are established in a scope that the contact salient 24 of the socket contact 20 slides on the second contact portion 41.

According to such configuration, under a state that the header 30 is fully inserted into the plug groove 12 of the socket 10 shown in FIG. 2, the contact salient 24 contacts both side portion of the concavity 45, and the protrusion 44 is positioned in the bottom face side of the plug groove 12 from the contact salient 24. Furthermore, in a process for inserting the header 30 into the plug groove 12 of the socket 10, the contact salient 24 elastically contacts both sides of the concavity 45 in the second contact portion 41 of the header post 40. Still furthermore, an area among the contact salient 24 which contacts the protrusion 44 is not overlapped to an area contacting the both sides of the concavity 45. Thus, even though extraneous substance is adhered on the contact salient 24 of the socket contact 20 or the second contact portion 41 of the header post 40 before the socket 10 and the header 30 are connected, the extraneous substance can be dropped into the concavity 45 in the process that the contact salient 24 slides on the surface of the second contact portion 41. Accordingly, in comparison with the case that no concavity 45 is provided on the second contact portion 41 of the header post 40, the possibility that the extraneous substance is wedged between the contact salient 24 and the second contact portion 41 becomes lower. In other words, by providing the protrusion 44 and the concavity 45 on the second contact portion 41 of the header post 40, poor contacting between the socket contact 20 and the header post 40 due to extraneous substance can be prevented. Furthermore, the contact salient 24 contacts at two points on both sides of the concavity 45, so that contact reliability of the socket contact 20 and the header post 40 can be increased. Still furthermore, the concavity 45 is provided on the second contact portion 41 of the header post 40 in the scope of sliding of the contact salient 24, so that the extraneous substance adhered on the contact salient 24 can be dropped in the concavity 45 surely, in comparison with the case that the concavity 45 is provided at a portion out of the scope of sliding of the contact salient 24.

Furthermore, when force is applied to the header 30 in a direction pulled out from the plug groove 12 of the socket 10, the contact salient 24 of the socket contact 20 contacts the protrusion 44 of the header post 40, so that it receives resistance force from the protrusion 44. Therefore, there is an advantageous merit that the header 30 is hardly pulled out from the plug groove 12 of the socket 10. By the way, when the header 30 is inserted into the plug groove 12 of the socket 10, the contact salient 24 of the socket contact 20 contacts the protrusion 44 of the header post 40. However, since the slanted face 44*a* is formed on the protrusion 44 in a manner so that the protruding dimension becomes larger at a position nearer to the terminal portion 42, the resistance when the header 30 is inserted into the plug groove 12 becomes smaller than the resistance when the header 30 is pulled out from the plug groove 12. Furthermore, since the position and shape of the concavity 45 is established in a manner so that the scope contacting with the protrusion 44 is not overlapped with the scope contacting with both sides of the concavity 45 on the contact salient 24, the extraneous substance pushed by the contact salient 24 is dropped into the concavity 45 while the contact salient 24 slides on the surface of the protrusion 44 and rarely wedged between the contact salient 24 and the second contact portion 41.

Figure 7B:
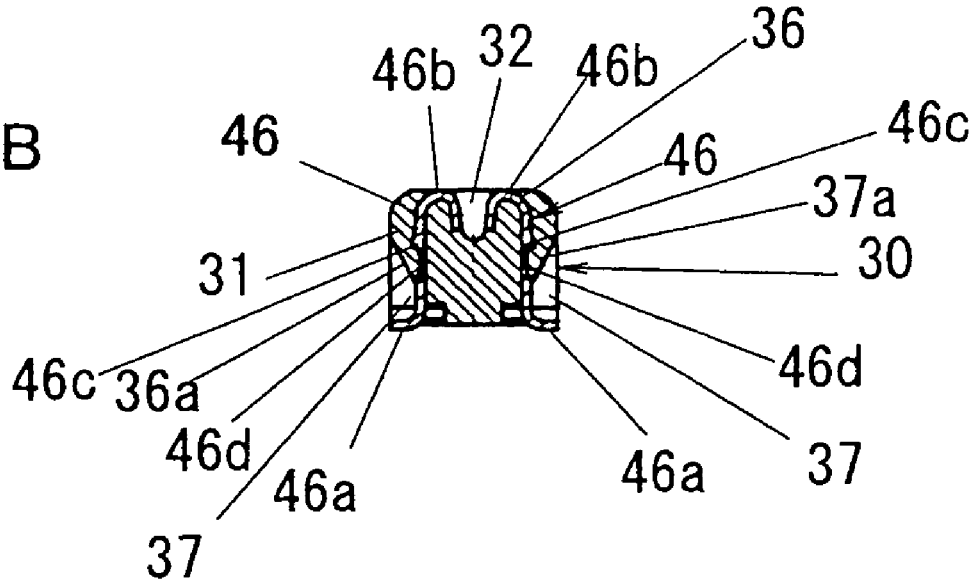
FIG. 7B is B-B sectional view in FIG. 6A.

In addition, header reinforcing metal fittings 46 are integrally embedded with the header body 31 by insert molding in both end portions 36 of the header body 31 in the longitudinal direction. The header reinforcing metal fittings 46 are formed on the same base metal as the header posts 40, and has substantially the same cross-sectional shape as shown in FIG. 7B. In other words, the header reinforcing metal fittings 46 correspond to called loss pins which are not electrically connected among the header posts 40. However, a portion of the header reinforcing metal fitting 46 corresponding to the second contact portion 41 is embedded in the both end portions of the header body 31 so that it is not exposed. Furthermore, a fixed portion 46*a* of the header reinforcing metal fitting 46 corresponding to the terminal portion 42 is cut off shorter than the terminal portion 42 of the header post 40 so as to be substantially the same as the largest dimension of the header body 31 in the widthwise direction. A protrusion 44 and a concavity 45 are provided on each header reinforcing metal fitting 46, similar to the header post 40. With inserting such a header reinforcing metal fitting 46 into the header body 31, resin which forms the header body 31 tightly contacts on the surfaces of the protrusion 44 and the concavity 45, so that the fixing strength between the header reinforcing metal fitting 46 and the header body 31 is increased, and the mechanical strength of the header body 31 is increased. Furthermore, since the header reinforcing metal fittings 46 are inserted into the header body 31, both end portions 36 of the header body 31 in the longitudinal direction can be made smaller in comparison with the case that the header reinforcing metal fittings are press-fitted into the header body. Then, the fixed portions 46*a* of the header reinforcing metal fittings 46 are soldered on lands of a circuit board, when the terminal portions 42 of the header posts 40 are soldered on a conductive pattern of the circuit board, simultaneously. Thereby, fixing strength of the header body 31 to the circuit board can be reinforced. Furthermore, the stress applied to the header post 40 when the socket 10 and the header 30 are connected can be reduced by the fixed portions 46*a* of the header reinforcing metal fittings 46. In other words, the header reinforcing metal fittings 46 serve as the terminal reinforcing metal fittings of the header posts 40.

Subsequently, the insert molding of the header 30 is described. Similar to the above-mentioned socket contact 20, since the pitch between each header post 40 is very narrow as 0.4 mm extent, it is nonsense to form the header post 40 and to insert them into a die for resin molding the header body 31 one by one. Therefore, slit processing is given to a side of a plate base metal so as to form a comb-shaped portion, and press working is further given to the comb-shaped portion to be a predetermined shape. Then, the header posts 40 which are arranged in a line on a base of the base metal are simultaneously inserted into the die for molding the header body 31. Finally, each header post 40 is cut off from the base metal after unification of the header body 31 and the header posts 40 by insert molding.

Figure 8B:
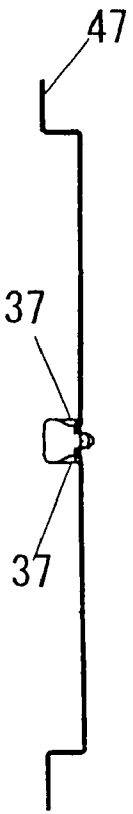
FIG. 8B is a side view thereof.
Figure 8A:
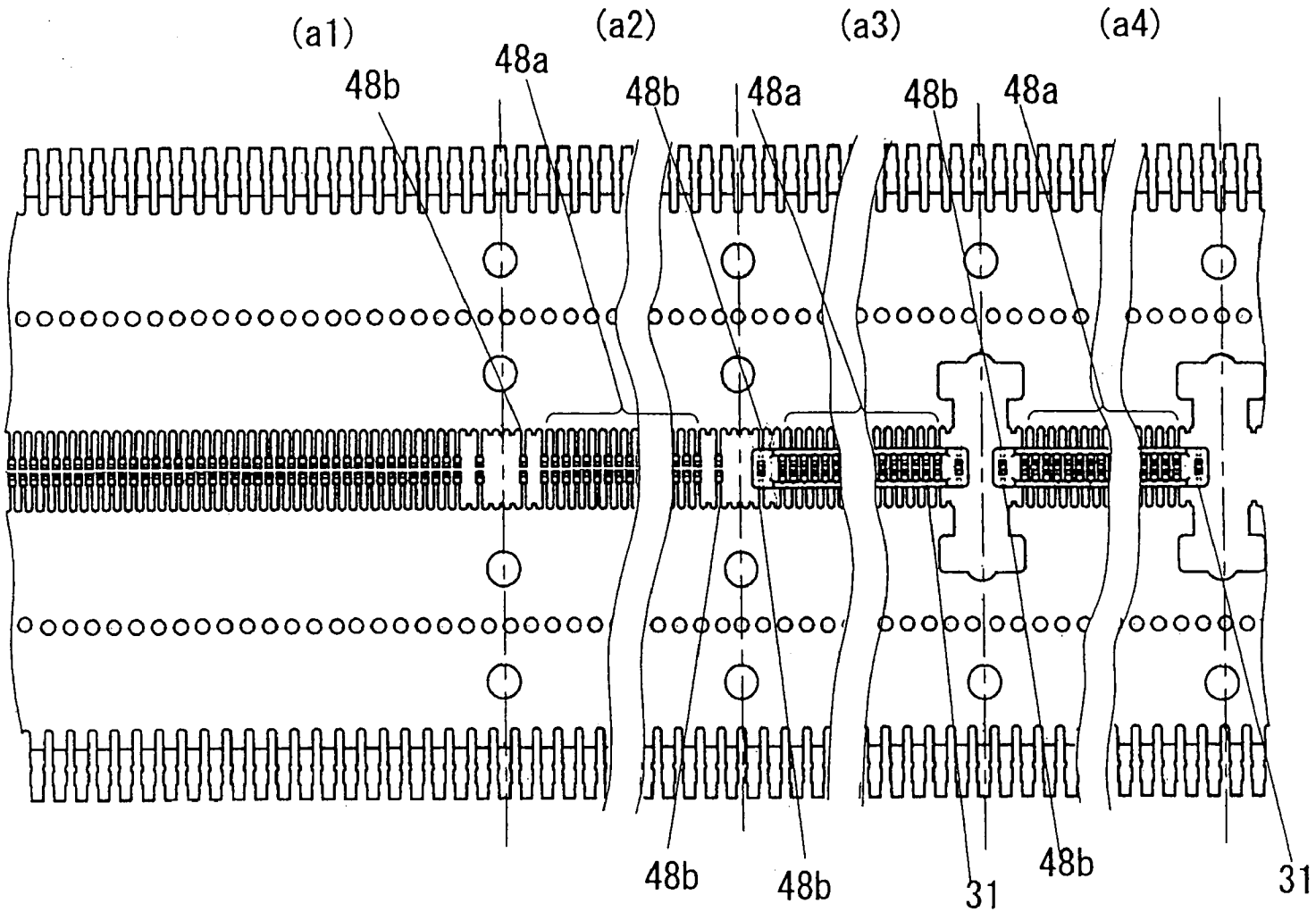
FIG. 8A is a front view showing an insert molding process of the header in the above embodiment.

Specifically, as shown in FIG. 8A, punching work is performed on a band shaped metal plate 47 for serially forming conductive terminals 48 of the same shape as the header posts 40 at a constant pitch on a side thereof (referring to portions 48*a* in the figure). In FIG. 8A, it is shown a state that two band shaped metal plates 47 are disposed so that the conductive terminals 48 of respective of them face each other. Subsequently, the same number of the conductive terminals 48*a* (for example, fifteen pairs) as that of the header post 40 are remained among the conductive terminals 48, and the rest of the conductive terminals 48 are removed by cutting so that a pair of conductive terminals 48*b* among plural pairs of the conductive terminals disposed at both sides of the conductive terminals 48*a* are remained (referring to a portion designated by a symbol "a2"). After that, the portions of the conductive terminals 48*a* and 48*b* are inserted into a die (not shown), and integrally insert molded with the header body 31 by resin (referring to a portion designated by a symbol "a3"). Then, front end portions of a pair of the conductive terminals 48*b* are cut off (referring to a portion designated by a symbol "a4"). FIG. 8B shows a side view at this time. Furthermore, each conductive terminal 48*s* is cut off from the metal plate 47, and the header 30 which is insert molded is taken out.

Figure 9:
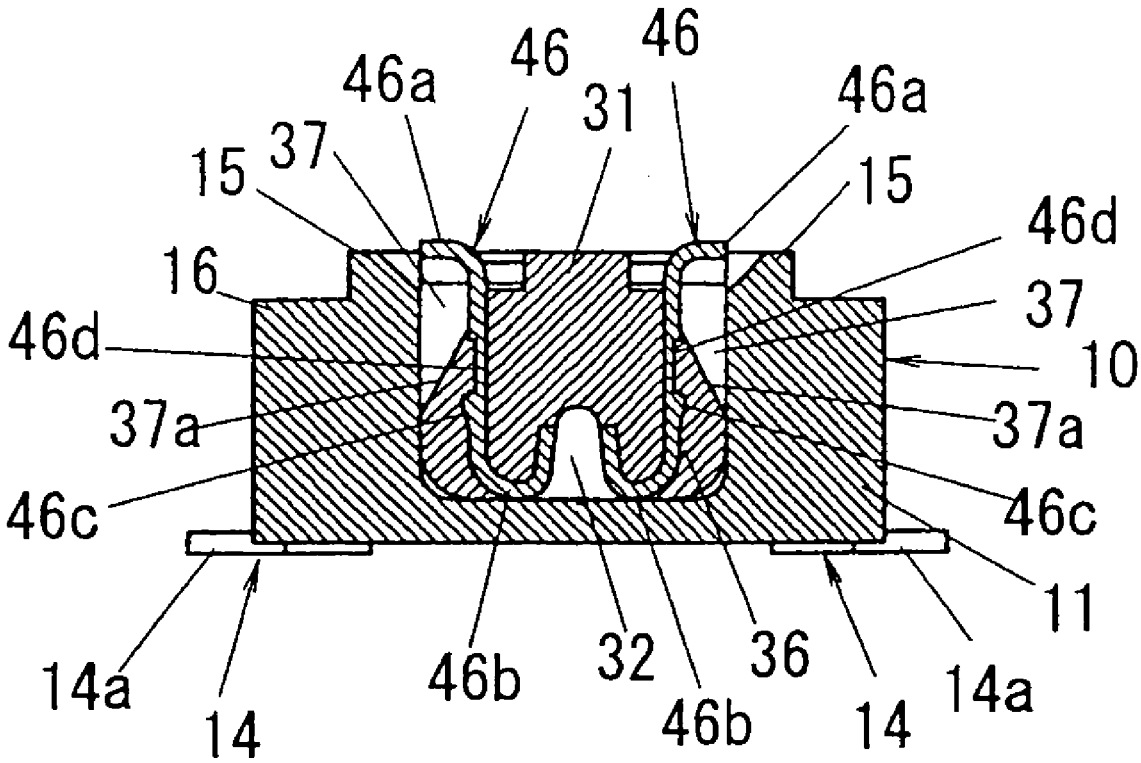
FIG. 9 is a sectional view in widthwise direction in a vicinity of an end portion of the connector in longitudinal direction when the header and the socket are connected in the above embodiment.
Figure 10A:
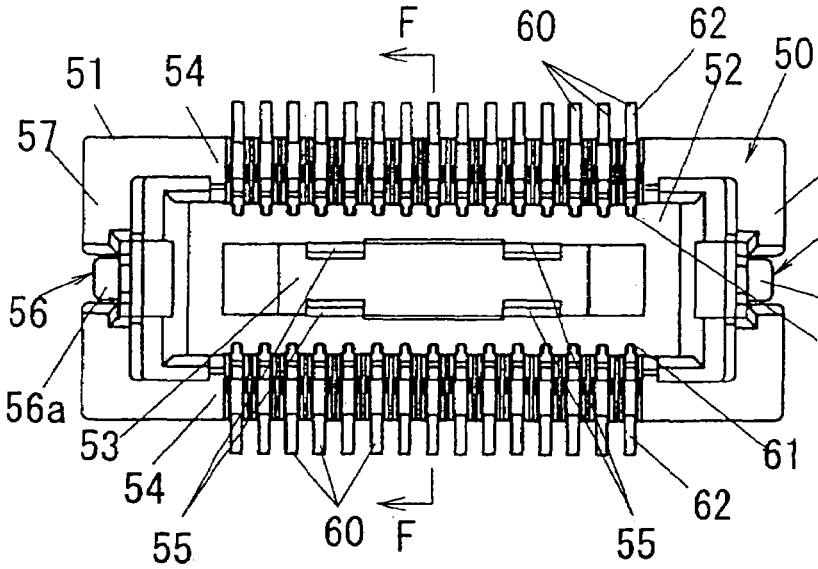
FIG. 10A is a front view showing a socket of a conventional connector.
Figure 10B:
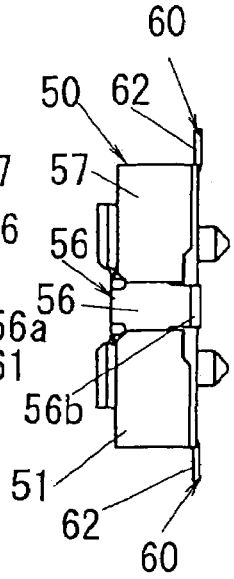
FIG. 10B is a right side view thereof and FIG. 10C is a bottom view thereof.
Figure 10C:
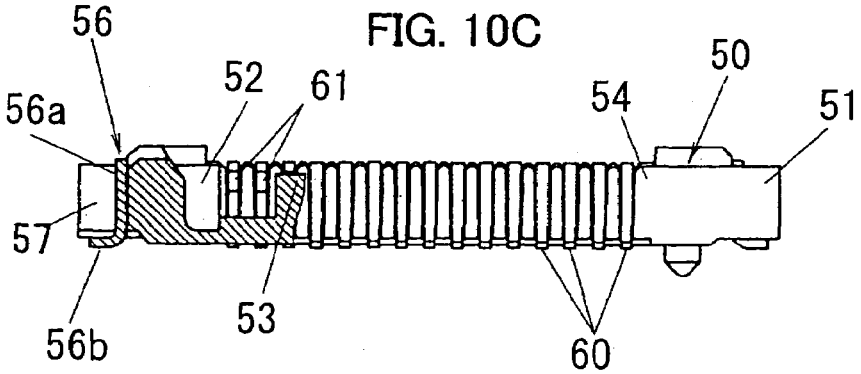
Figure 11:
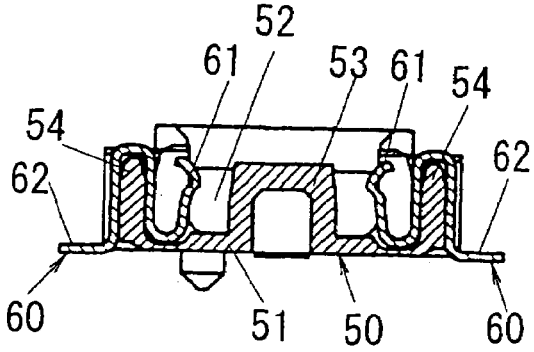
FIG. 11 is a side sectional view of the socket of the above conventional connector.

The socket 10 and the header 30 of the connector 1 in accordance with this embodiment configured as above are respectively mounted on two circuit boards which are to be connected electrically. Specifically, the terminal portions 23 of the socket contacts 20 of the socket are soldered on a conductive pattern of one of the circuit boards, for example, a hard circuit board, and the terminal portions 42 of the header posts 40 of the header 30 are soldered on a conductive pattern of the other circuit board, for example, an FPC. When the header 30 is engaged with the plug groove 12 of the socket 10, the socket contacts 20 of the socket 10 are electrically connected to the header posts 40 of the header 30. Simultaneously, the conductive pattern of the hard circuit board is electrically connected to the conductive pattern of the FPC via the socket contacts 20 and the header posts 40. At this time, as shown in FIG. 9, since the fixed portions 46*a* of the header reinforcing metal fittings 46 are short, it is possible to connect the conductive patterns of the circuit boards electrically with each other with no contacting of them to the guide walls 15 of the socket body 11.

As mentioned above, according to this embodiment, the socket reinforcing metal fittings 14 are integrally insert-molded with the socket body 11, and the header reinforcing metal fittings 46 are integrally insert-molded with the header body 31, so that it is possible not only to increase the mechanical strengths of the socket body 11 and the header body 31 without forming any protruding table in the plug groove 12 of the socket body 11 but also to downsize the socket body 11 and the header body 31, and the connector 1, consequently. Furthermore, the header reinforcing metal fittings 46 are provided with a distances from the header posts 40, so that the strength of soldering of the header reinforcing metal fittings 46 can be increased. Still furthermore, the header 30 can be inserted into the socket 10 without interference of the header reinforcing metal fittings 46 with the socket body 11.

In addition, in this embodiment, the contact salient 24 of the socket contact 20 is elastically contacted with both sides of the concavity 45 on the second contact portion 41 of the header post 40, and the extraneous substance is dropped into the concavity 45 in the process that the contact salient 24 slides on the surface of the second contact portion 41, so that the possibility that the extraneous substance is wedged between the contact salient 24 and the second contact portion 41 is reduced, and the contact reliability is increased. The shapes and the contact condition of the contact salient 24 of the socket contact 20 and the second contact portion 41 of the header post 40, however, are not limited to the description of the above-mentioned embodiment. For example, it is possible that the face of the contact salient 24 of the socket contact 20 which contacts with the second contact portion 41 of the header post 40 is formed in a shape (for example, curved surface shape) that a center portion in the widthwise direction thereof is protruded toward the second contact portion 41 of the header post 40 than both side portion. In such case, the center portion of the contact salient 24 of the socket contact 20 in the widthwise direction proceeds into the concavity 45, and contacts at two points with two slanted faces in the concavity 45 or edges of the opening of the concavity 45. Although the shape of the socket contact 20 becomes complex in comparison with the case that the contact salient 24 of the socket contact 20 and the second contact portion 41 of the header post 40 are contacted with each other on flat surfaces, the contacting area of the contact salient 24 and the second contact portion 41 becomes smaller so that the contact pressure increases. As a result, the extraneous substance can easily be discharged between the contact salient 24 and the second contact portion 41, so that the contact reliability of the socket contact 20 and the header post 40 is increased.

Furthermore, it is sufficient that the connector 1 in accordance with the present invention includes at least the header 30 comprising the header body 31 made of an insulation material and plural pairs header posts 40 held on both side walls of the header body 31 in the longitudinal direction, and the socket comprising the socket body 11 made of an insulation material and having the plug groove 12 of substantially rectangular shape and plural pairs of the socket contacts 20 held on both side walls of the plug groove 12 of the socket body 11 in the longitudinal direction and contacting with the header posts 40 when the header 30 is engaged with the plug groove 12; the socket body 11 is reinforced by a pair of socket reinforcing metal fittings 14 which are integrally inserted into both end portions 16 thereof in the longitudinal direction; a pair of the socket reinforcing metal fittings 14 is formed to protrude outward from both side walls 13 of the plug groove 12 in the longitudinal direction, and has a pair of fixed portions 14*a* to be soldered on lands of a circuit board, and a coupling portion connecting between the fixed portions 14*a* and embedded in the end portions 16 of the socket body 11 in the longitudinal direction. Furthermore, the header body 31 is reinforced by a pair of header reinforcing metal fittings 46 respectively integrally inserted into both end portions 36 thereof in the longitudinal direction; and each header reinforcing metal fitting 46 has substantially the same cross sectional shape in the widthwise direction as that of the header post 40.

This application is based on Japanese patent application 2004-107305 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

The invention claimed is:

1. A connector comprising:

a header having a header body formed of an insulation material, and a plurality of header posts held on side walls of the header body, the header body having two pairs of header reinforcing metal fittings, each pair of the header reinforcing metal fittings being embedded into end portions of the header body in a longitudinal direction so as to extend in a width-wise direction of the header, each header reinforcing metal fitting being not electrically connected to a land of a circuit board, and each pair of the header reinforcing metal fittings having a cross-section when viewed in the width-wise direction of the header, substantially the same as a cross-section of the header posts excluding terminal ends; and a socket having a socket body formed of an insulation material and a plug groove configured to engage the header, the socket having a plurality of socket contacts held on side walls of the plug groove, the socket contacts being configured to contact the header posts when the header engages the plug groove, the socket body having a pair of socket reinforcing metal fittings inserted into end portions of the socket body and extending in a width-wise direction of the socket, each of the socket reinforcing metal fittings having a pair of fixed portions configured to be soldered on lands of a circuit board and a coupling portion which connects the fixed portions, the coupling portion embedded in the end portion of the socket body and extending in the width-wise direction of the socket body, and each fixed portion protruding outwardly from the side wall of the plug groove in the width-wise direction of the socket.

2. The connector in accordance with claim 1, the header reinforcing metal fitting comprising a protrusion and a concavity successively provided on a portion of the header reinforcing metal fitting and in a height-wise direction of the header reinforcing metal fitting, wherein the header reinforcing metal fitting extends from a side of a face facing the socket toward a side of a face configured to be mounted on a circuit board.

3. The connector in accordance with claim 1, the header post comprising a protrusion and a concavity successively provided on a contact portion of the header post extending in a height-wise direction of the header from a first face configured to configured to contact a bottom surface of the plug groove to a second face opposite to the first face.

4. The connector in accordance with claim 3, wherein the protrusion is positioned in a height-wise direction of the header post closer to the first face than to the second face.

5. The connector in accordance with claim 3, the protrusion comprising a slanted face provided on an outer face of the protrusion so that a dimension of the protrusion becomes larger as the slanted face extends towards the second face in a height-wise direction of the header post.

6. The connector in accordance with claim 3, wherein the concavity comprises an elongated channel extending in the heightwise direction of the header post.

7. The connector in accordance with claim 6, wherein the concavity has two slanted faces oriented such that a cross-section of the concavity in the widthwise direction of the header post has a substantially V-shape cross-section.

8. The connector in accordance with claim 3, wherein a dimension of the concavity in the width-wise direction of the header post is formed to be larger than a width dimension of the protrusion and smaller than a width of a contact portion of the socket contact in the width-wise direction of the header post.

9. The connector in accordance with claim 3, wherein dimensions and a position of the concavity in the height-wise direction of the header post are configured to allow the contact portion of the socket contact to slide on the contact portion of the header post.

* * * * *